United States Patent [19]

Hoffacker et al.

[11] Patent Number: 4,605,474

[45] **Date of Patent: * Aug. 12, 1986**

[54] ALKALINE CYANIDE BATH FOR ELECTROLYTIC DEPOSITION OF COPPER-TIN-ALLOY COATINGS

[76] Inventors: Gerd Hoffacker, Neue Strasse 74/6, 7070 Schwabisch Gmund; Willi Müller, Obere Morgen 44, 7345 Deggingen, both of Fed. Rep. of Germany

[ * ] Notice: The portion of the term of this patent subsequent to Jan. 21, 2003 has been disclaimed.

[21] Appl. No.: 769,343

[22] Filed: Aug. 26, 1985

Related U.S. Application Data

[63] Continuation of Ser. No. 666,318, Oct. 30, 1984, Pat. No. 4,565,608.

[30] Foreign Application Priority Data

Nov. 2, 1983 [DE] Fed. Rep. of Germany ..... 3339541

[51] Int. Cl.[4] ..... C25D 3/58; C25D 3/60

[52] U.S. Cl. ..... 204/44

[58] Field of Search ..... 204/44, 123

[56] References Cited

U.S. PATENT DOCUMENTS

| | | | |
|---|---|---|---|
| 2,435,967 | 2/1948 | Jernstedt | 204/44 |
| 2,436,316 | 2/1948 | Lum | 204/44 |
| 2,658,032 | 11/1953 | Faust et al. | 204/44 |
| 2,854,388 | 9/1958 | Safranek et al. | 204/44 |
| 3,440,151 | 4/1969 | Duva | 204/44 |

FOREIGN PATENT DOCUMENTS

| | | | |
|---|---|---|---|
| 860300 | 12/1952 | Fed. Rep. of Germany | 204/44 |
| 2256025 | 7/1973 | Fed. Rep. of Germany | 204/44 |
| 57-60092 | 7/1982 | Japan | 204/44 |
| 48689 | 3/1983 | Japan | 204/44 |
| 58-91181 | 8/1983 | Japan | 204/44 |

*Primary Examiner*—G. L. Kaplan

*Attorney, Agent, or Firm*—Cushman, Darby & Cushman

[57] ABSTRACT

There is provided a bath composition for the electrolytic deposition of copper-tin alloy coatings which contain besides the customary components (copper cyanide, stannate, complex former, free cyanide, and hydroxide) at least one organic material from at least one of the following groups:

(a) fatty acid amidoalkyl dialkylamine oxides of the general formula $$R_1CO—NH(CH_2)_n—N(R_2)_2\rightarrow 0,$$

wherein $R_1$ is an alkyl group having 11 to 17 carbon atoms, $R_2$ is an alkyl group having 1 to 5 carbon atoms, and n is 1–30

(b) fatty acid amidoalkyl-dialkylamine betaines of the general formula $$R_1CO—NH(CH_2)_n—\oplus N(R_2)_2—CH_2—COO\ominus,$$

wherein $R_1$ is an alkyl group having 11 to 17 carbon atoms, $R_2$ is an alkyl group having 1 to 5 carbon atoms, and n is 1–30, and (c) ethoxylated naphthols of the general formula

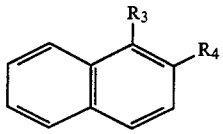

wherein $R_3$ is H or $O(CH_2—CH_2O)_mH$, $R_4$ is $O(CH_2CH_2O)_mH$ or H m=10 to 14, e.g., 10, 12, or 14 in an amount of 0.05 to 5 g/l.

7 Claims, No Drawings

ALKALINE CYANIDE BATH FOR ELECTROLYTIC DEPOSITION OF COPPER-TIN-ALLOY COATINGS

This application is a continuation of Ser. No. 666,318 filed Oct. 30, 1984 and now U.S. Pat. No. 4,565,608.

BACKGROUND OF THE INVENTION

The invention is directed to an alkaline cyanide bath for the electrolytic deposition of brilliant copper-tin-alloy coatings, especially copper-tin alloy coatings having 45 to 60 percent copper, consisting of (or consisting essentially of) 1 to 60 g/l of copper in the form of copper cyanide, 7 to 30 g/l of tin in the form of stannate, e.g., alkali stannate such as sodium stannate or potassium stannate, 0.1 to 100 g/l of one or more complex formers of the group consisting of phosphates, e.g., sodium phosphate or potassium phosphate, polyphosphates, e.g., sodium polyphosphate, or potassium polyphosphate, phosphonates, e.g., disodium methylenediphosphonate, disodium hydroxymethanediphosphonate, disodium hydroxyethanediphosphonate, and polyhydroxy carboxylic acids and salts thereof, e.g., tartaric acid, citric acid, gluconic acid, and their sodium and potassium salts, 1 to 50 g/l of free alkali cyanide, e.g., sodium cyanide or potassium cyanide, 1 to 50 g/l of free alkali hydroxide, e.g., sodium hydroxide or potassium hydroxide, and 0 to 50 g/l of alkali carbonate, e.g., sodium carbonate or potassium carbonate.

The coating can be deposited, for example, on steel.

It has been known for many years to deposit copper-tin alloy coatings from electrolytic baths. There have especially been used coatings which contain 45 to 60 percent copper, preferably 55 to 60 percent copper, since these have a clear silver brightness and is not inclined to tarnish. Therefore, they are used in the decorative electroplating as replacements for, for example, silver, chromium, or aluminum. However, copper-tin alloy coatings also find increasing industrial use because of their very good soldering properties, their resistance to abrasion, and their low electrical contact resistance.

Such copper-tin alloys were predominantly deposited from alkaline, cyanide containing electrolysis baths which contain the tin as stannate. Other electrolysis baths contain phosphate and pyrophosphate as complex former and also colloids, such as e.g., polypeptides as brighteners (German OS 860 300). These known baths must be operated at high, constant temperatures (65° C. and higher) in order to obtain uniform layers of constant composition. The same is true also for the adjustment of the cyanide and hydroxide concentration in the bath. Therefore, working with these baths is difficult and cumbersome.

Therefore, it was the problem of the present invention to develop an alkaline cyanide bath for the electrolytic deposition of bright to brilliant copper-tin-alloy coatings, especially copper-tin alloy coatings having 45 to 60 percent copper, consisting of (or consisting essentially of) 1 to 60 g/l of copper in the form of copper cyanide, 7 to 30 g/l of tin in the form of stannate, e.g., alkali stannate such as sodium stannate or potassium stannate, 0.1 to 100 g/l of one or more complex formers of the group consisting of phosphates, e.g., sodium phosphate or potassium phosphate, polyphosphates, e.g., sodium polyphosphate, or potassium polyphosphate, phosphonates, e.g., disodium methylenediphosphonate, disodium hydroxymethanediphosphonate, disodium hydroxyethanediphosphonate, and polyhydroxy carboxylic acids, e.g., tartaric acid, citric acid, gluconic acid, 1 to 50 g/l of free alkali hydroxide, e.g., sodium hydroxide or potassium hydroxide, and 0 to 50 g/l of alkali carbonate, e.g., sodium carbonate or potassium carbonate which can be operated at lower temperatures and in which the coating composition is less strongly dependent upon the deviations of the bath components.

SUMMARY OF THE INVENTION

This problem has been solved according to the invention by providing that the bath contain in addition to the materials just set forth at least one organic material from at least one of the following groups:

(a) fatty acid amidoalkyl dialkylamine oxides of the general formula $$R_1CO—NH(CH_2)_n—N(R_2)_2 \rightarrow 0,$$

wherein $R_1$ is an alkyl group having 11 to 17 carbon atoms, $R_2$ is an alkyl group having 1 to 5 carbon atoms, and n is 1–30

(b) fatty acid amidoalkyl-dialkylamine betaines of the general formula $$R_1CO—NH(CH_2)_n—^{\oplus}N(R_2)_2—CH_2—COO^{\oplus},$$

wherein $R_1$ is an alkyl group having 11 to 17 carbon atoms, $R_2$ is an alkyl group having 1 to 5 carbon atoms, and n is 1–30, and (c) ethoxylated naphthols of the general formula

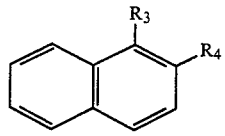

wherein $R_3$ is H or $O(CH_2—CH_2O)_mH$, $R_4$ is $O(CH_2CH_2O)_mH$ or H m=10 to 14, e.g., 10, 12, or 14 in an amount of 0.05 to 5 g/l.

In the compounds just mentioned, $R_1$ can be, for example, undecyl, dodecyl, tridecyl, pentadecyl, or heptadecyl, $R_2$ can be, for example, methyl, ethyl, propyl, isopropyl, butyl, sec. butyl, or amyl, n can be, for example, 1, 2, 3, 4, 5, 6, 10, 12, 18, 20, 24, or 30.

The corresponding $\beta$-naphthol derivatives have proven especially desirable.

Preferably, the baths contain 1 to 3 g/l of these organic materials from one or more of groups (a), (b), and (c).

The coatings deposited from such baths are bright but not yet brilliant. For the deposition of brilliant copper-tin alloy coatings, there is additionally added to the bath 0.05 to 2 g/l of one or more brighteners selected from one or more of the following groups.

(a) polyethylenediamine of the general formula $$H_2N—(CH_2)_o—NH_2$$

where o is 6 to 100, e.g., 6, 7, 8, 10, 12, 14, 16, 18, 20, 30, 40, 50, 60, or 100, or the reacton products with benzyl chloride or epichlorohydrin, (b) benzaldehyde having one or more hydroxy and/or alkoxy groups on the nucleus, and cinnamicaldehyde or their reaction products with thiocyanates and sulfites, (c) ethinols, ethindiols, and their ethoxylates and propoxylates of the general formula $$R_5C{\equiv}C{-}CH_2OR_6$$

wherein $R_5$=H or $CH_2OR_6$ and $R_6$=H, $C_2H_5$, or $C_3H_7$, or (d) benzylpyridinecarboxylate of the formula $$(C_6H_5{-}CH_2{-}C_5H_4N^{\oplus}{-}COONa)Cl^{\ominus}.$$

$Cl^{\ominus}$=chloride.

Advantageously, the baths contain 0.8 to 1.5 g/l of this brightener. Since the compounds of brightener groups (a) and (b) are difficulty soluble in water, they are advantageously first reacted with benzyl chloride or epichlorohydrin, respectively thiocyanate or sulfite.

The baths of the invention can be operated with insoluble anodes, such as, e.g., with fine steel anodes. The operating temperatures are between 38° and 58° C., the current densities between 0.4 and 3.0 A/dm$^2$, and the pH between 11.5 and 12.5.

There have proven good baths containing 2 to 10 g/l copper in the form of copper cyanide, 10 to 20 g/l tin in the form of alkali stannate, 10 to 50 g/l complex former, 5 to 30 g/l free alkali cyanide, 5 to 30 g/l free alkali hydroxide, 5 to 20 g/l alkali carbonate, and 0.8 to 1.5 g/l brightener.

As brighteners, there have proven useful from group (b), e.g., p-methoxybenzaldehyde (anisaldehyde), 4-hydroxy-3-methoxybenzaldehyde (vanillin) and cinnamaldehyde, from group (c), e.g., butin-2-diol-1,4,butinediol monopropoxylate, and propargyl alcohol monoethoxylate. Advantageously, however, there is used polyethylenediamine and benzyl-pyridine carboxylate.

The composition can consist essentially of or consist of the stated materials.

Unless otherwise indicated, all parts and percentages are by weight.

The following examples explain the baths of the invention in greater detail.

DETAILED DESCRIPTION

Example 1

On steel sheets there were obtained from an aqueous bath containing 8.4 g/l copper (I) cyanide, 58 g/l sodium stannate, 25 g/l potassium sodium tartrate, 25 g/l tetrasodium diphosphate, 20 g/l each of free sodium cyanide and sodium hydroxide, 15 g/l of sodium carbonate, and 0.3 g/l of ethoxylated β-naphthol having m=12 (average number of units) at a temperature of 58° C. and current density of 1 A/dm$^2$ in 50 minutes a 5 μm thick, bright, white coatings which contained 53 percent copper and did not tarnish.

Example 2

On ferrous parts there were obtained from an aqueous bath containing 2.8 g/l copper (I) cyanide, 46.4 g/l sodium stannate, 25 g/l potassium sodium tartrate, 25 g/l tetrasodium diphosphate, 20 g/l each sodium cyanide and sodium hydroxide, 15 g/l sodium carbonate, 0.3 g/l of a fatty acid amido-alkyl-dialkylamine-betaine (where $R_1$ is $C_{15}$, $R_2$ is methyl, and n is 6), and 1.1 g/l butin-2-diol-1,4 at 42° C. and 1 A/dm$^2$ in one hour a 5 μm thick white coatings which contained 49 percent copper and were very brilliant.

Example 3

On nickel parts there was deposited from an aqueous bath containing 2.8 g/l copper (I) cyanide, 46.4 g/l sodium stannate, 25 g/l tetrasodium diphosphate, 25 g/l dipotassium tartrate, 16 g/l free potassium cyanide, 14 g/l free potassium hydroxide, 1 g/l of a fatty acid amidoalkyldialkylaminoxide ($R_1$ is $C_{12}$, $R_2$ is propyl, and n is 4), and 0.7 g/l of benzylpyridine carboxylate at 42° C. and 1 A/dm$^2$ a white, brilliant coating having a copper content of 50 percent.

Example 4

On steel sheets there were obtained from an aqueous bath containing 1.4 g/l copper (I) cyanide, 23.2 g/l sodium stannate, 25 g/l sodium citrate, 25 g/l sodium phosphate, 13 g/l each of potassium cyanide and potassium hydroxide, 1 g/l ethoxylated β-naphthol (where m is 10), 0.1 g/l polyethylene-diamine (where o is 50), and 0.02 g/l propargyl alcohol at 42° C. and 0.8 A/dm$^2$ brilliant white coatings (4 μm in 40 minutes) having 57 percent copper.

Example 5

By increasing the Cu/Sn ratio in the bath, there can also be deposited yellow gold and rose copper-tin alloys. There were obtained from a bath containing 8.4 g/l copper (I) cyanide, 48 g/l sodium stannate, 40 g/l dipotassium phosphate, 25 g/l tetrasodium diphosphate, 16 g/l sodium cyanide, 12 g/l sodium hydroxide, 15 g/l sodium carbonate, 2 g/l ethoxylated β-naphthol (where m is 10), and 0.2 g/l vanillin at 45° C. and 1 A/dm$^2$ yellow gold, brilliant coatings having 70 percent copper.

The entire disclosure of German priority application P.3339541.1-45 is hereby incorporated by reference.

What is claimed is:

1. In an alkaline cyanide bath for the electrolytic deposition of bright to brilliant copper-tin alloy coatings, the improvement comprising including in the bath at least one organic material from at least one of the following groups:

(a) fatty acid amidoalkyl dialkylamine oxides of the general formula $$R_1CO{-}NH(CH_2)_n{-}N(R_2)_2{\rightarrow}0,$$

wherein $R_1$ is an alkyl group having 11 to 17 carbon atoms, $R_2$ is an alkyl group having 1 to 5 carbon atoms, and n is 1–30

(b) fatty acid amidoalkyl-dialkylamine betaines of the general formula $$R_1CO{-}NH(CH_2)_n{-}^{\oplus}N(R_2)_2{-}CH_2{-}COO^{\ominus},$$

wherein $R_1$ is an alkyl group having 11 to 17 carbon atoms, $R_2$ is an alkyl group having 1 to 5 carbon atoms, and n is 1–30, and (c) ethoxylated naphthols of the general formula

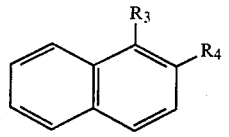

wherein
$R_3$ is H or $O(CH_2—CH_2O)_mH$,
$R_4$ is $O(CH_2CH_2O)_mH$ or H
m=10 to 14
in an amount of 0.05 to 5 g/l.

2. An alkaline cyanide bath according to claim 1 consisting essentially of said organic material, water, 1 to 60 g/l of copper in the form of copper cyanide, 7 to 30 g/l of tin in the form of alkali stannate, 0.1 to 100 g/l of at least one complex former of the group consisting of phosphates, polyphosphates, phosphonates, and polyhydroxy carboxylic acids and salts thereof, 1 to 50 g/l of free alkali cyanide, 1 to 50 g/l of free alkali hydroxide, and 0 to 50 g/l of alkali carbonate.

3. An alkaline cyanide bath according to claim 2 containing 1 to 3 g/l of the organic material.

4. An alkaline cyanide bath according to claim 2 wherein the organic material is a fatty acid amidoalkyl dialkylamine oxide.

5. An alkaline cyanide bath according to claim 1 wherein the organic material is a fatty acid amidoalkyl dialkylamine betaine.

6. A process of electrolytically depositing a bright to brilliant copper-tin alloy coating on a metal substrate comprising employing the alkaline cyanide bath of claim 1 at a temperature of 38° to 58° C.

7. A process according to claim 6 wherein there is employed a current density between 0.4 and 3.0 $A/dm^2$ and the pH of the bath is 11.5 to 12.5.

* * * * *